US006986495B2

(12) United States Patent
Pinkleton et al.

(10) Patent No.: US 6,986,495 B2
(45) Date of Patent: Jan. 17, 2006

(54) WALKWAY BRACKET FOR USE WITH HELICAL ANCHOR

(76) Inventors: Michael A. Pinkleton, 35850 Industrial Rd., Livonia, MI (US) 48150; Robert W. Showler, 8175 Big Lake Rd., Clarkston, MI (US) 48346

( * ) Notice: Subject to any disclaimer, the term of this patent is extended or adjusted under 35 U.S.C. 154(b) by 0 days.

(21) Appl. No.: 10/649,524

(22) Filed: Aug. 27, 2003

(65) Prior Publication Data

US 2004/0046095 A1 Mar. 11, 2004

Related U.S. Application Data

(60) Provisional application No. 60/406,587, filed on Aug. 28, 2002.

(51) Int. Cl.
*A47B 97/00* (2006.01)

(52) U.S. Cl. ..... 248/507; 248/508; 52/155; 52/157; 405/272; 405/288

(58) Field of Classification Search ..... 248/500, 248/507, 508, 156, 545, 530; 52/DIG. 11, 52/155, 157, 705, 169.9, 299; 405/272, 288, 405/290

See application file for complete search history.

(56) References Cited

U.S. PATENT DOCUMENTS

| | | | | | |
|---|---|---|---|---|---|
| 334,831 | A | * | 1/1886 | Wilcox | 248/48.2 |
| 948,901 | A | * | 2/1910 | Nakashjian | 248/48.1 |
| 2,826,281 | A | * | 3/1958 | Worth | 52/158 |
| 3,606,231 | A | * | 9/1971 | Kilborn | 248/354.3 |
| 3,608,928 | A | * | 9/1971 | Hooker | 280/768 |
| 3,750,349 | A | * | 8/1973 | Deike | 52/23 |
| 3,802,138 | A | * | 4/1974 | McCarter | 52/148 |
| 3,845,597 | A | * | 11/1974 | Foster | 52/166 |
| 4,068,427 | A | * | 1/1978 | Camardo | 52/127.2 |
| 4,272,933 | A | * | 6/1981 | Lopes | 52/149 |
| 4,379,650 | A | * | 4/1983 | Frankenfield | 403/316 |
| 4,546,581 | A | * | 10/1985 | Gustafson | 52/169.9 |
| 4,778,142 | A | * | 10/1988 | Roba | 248/545 |
| 4,911,580 | A | * | 3/1990 | Gregory et al. | 405/230 |
| 4,976,077 | A | * | 12/1990 | Tucker | 52/126.6 |
| 5,011,336 | A | | 4/1991 | Hamilton et al. | |
| 5,120,163 | A | | 6/1992 | Holdeman et al. | |
| 5,139,368 | A | | 8/1992 | Hamilton et al. | |
| 5,171,107 | A | | 12/1992 | Hamilton et al. | |
| 5,213,448 | A | | 5/1993 | Seider et al. | |
| 5,919,005 | A | | 7/1999 | Rupiper | |
| 5,921,035 | A | * | 7/1999 | Kempf | 52/157 |
| 6,256,940 | B1 | * | 7/2001 | MacKarvich | 52/126.6 |
| 6,352,391 | B1 | | 3/2002 | Jones | |
| 6,371,139 | B1 | * | 4/2002 | Simchori | 135/20.1 |
| 6,468,002 | B1 | * | 10/2002 | Gregory et al. | 405/230 |
| 6,702,239 | B2 | * | 3/2004 | Boucher | 248/156 |

OTHER PUBLICATIONS

A.B. Chance Company and Hubbell/Chance, "Tieback Anchors", Bulletin 31–9601, Apr. 1998, pp. 1–8.

A.B. Chance Company and Hubbell Power Systems, Inc. "Helical Pier Foundation Systems", Bulletin 01–9501, Jun. 1999, pp. 1–8.

A.B. Chance Company and Hubbell Power Systems, Inc., "Helical Pier Foundation Systems Technical Manual", Bulletin 01–9601, Jan. 2000, pp. 1–12.

Seider, Gary L., Hubbell Power Systems, Inc., "Versatile Steel Screw Anchors", Bulletin 01–0001, 2000, pp. 1–5.

* cited by examiner

*Primary Examiner*—Kimberly Wood
(74) *Attorney, Agent, or Firm*—Buteel Long

(57) ABSTRACT

A bracket for connecting to and supporting a beam of a walkway releasably attaches to a helical anchor. The bracket includes a beam restrainer for supporting a beam and a connecting plate releasably attached to a connector assembly. The connector assembly releasably attaches the helical anchor to the bracket and accommodates differences in spacing at various installation locations.

13 Claims, 3 Drawing Sheets

WALKWAY BRACKET FOR USE WITH HELICAL ANCHOR

CROSS-REFERENCE TO RELATED APPLICATION

This application claims the benefit of U.S. provisional patent application Ser. No. 60/406,587 filed Aug. 28, 2002.

BACKGROUND OF THE INVENTION

The present invention relates generally to a screw anchor apparatus and in particular to a bracket for use with a helical anchor in supporting walkways.

Helical or screw anchors are well known. Helical anchors are utilized in the geotechnical industry to anchor building foundations in unstable soil and to stabilize and/or repair the integrity of existing foundations and the like. Walkways, such as environmental walkways, are utilized in environmentally sensitive areas, construction sites, excavation sites and other locations where it is advantageous for providing a walking surface that is above the level of the ground. These walkways are often supported by helical anchors due to poor site soil quality and to minimize the environmental impact of the walkway on the soil and vegetation in the area. The helical anchors are typically attached to the walkways by support brackets and the like. Often, the helical anchors and brackets must be disadvantageously designed and constructed on the construction site and are not easily adjustable for specific site conditions.

It is desirable, therefore, to provide an integrated support for a walkway supported by a screw anchor that is customizable at the construction site and reduces the amount of time required to install the walkway.

SUMMARY OF THE INVENTION

A bracket apparatus for connecting and supporting a beam of a walkway and a battered helical anchor includes a beam restrainer portion having a generally horizontally extending bottom plate for supporting a beam and at least one generally vertically extending side plate for attachment to the beam. A generally vertically extending shaft includes an upper end attached to the bottom plate and a lower end. The shaft includes a connecting plate attached thereto and extending radially therefrom. A connector assembly includes an upper end for connecting to the connecting plate and a lower end for connecting to an upper end of the battered helical anchor.

The connector assembly of the present invention forms a robust connection between the restrainer portion and the battered helical anchor and, therefore, is operable to transmit forces from the restrainer portion to the battered helical anchor. Because this robust connection, the walkway bracket apparatus is advantageously able to resist walkway movement in all directions. The present invention advantageously provides an apparatus that integrates a walkway support and a screw anchor assembly for supporting walkways in conjunction with the use of a helical anchor. The present invention also provides an apparatus that is easily adjustable for specific site conditions.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
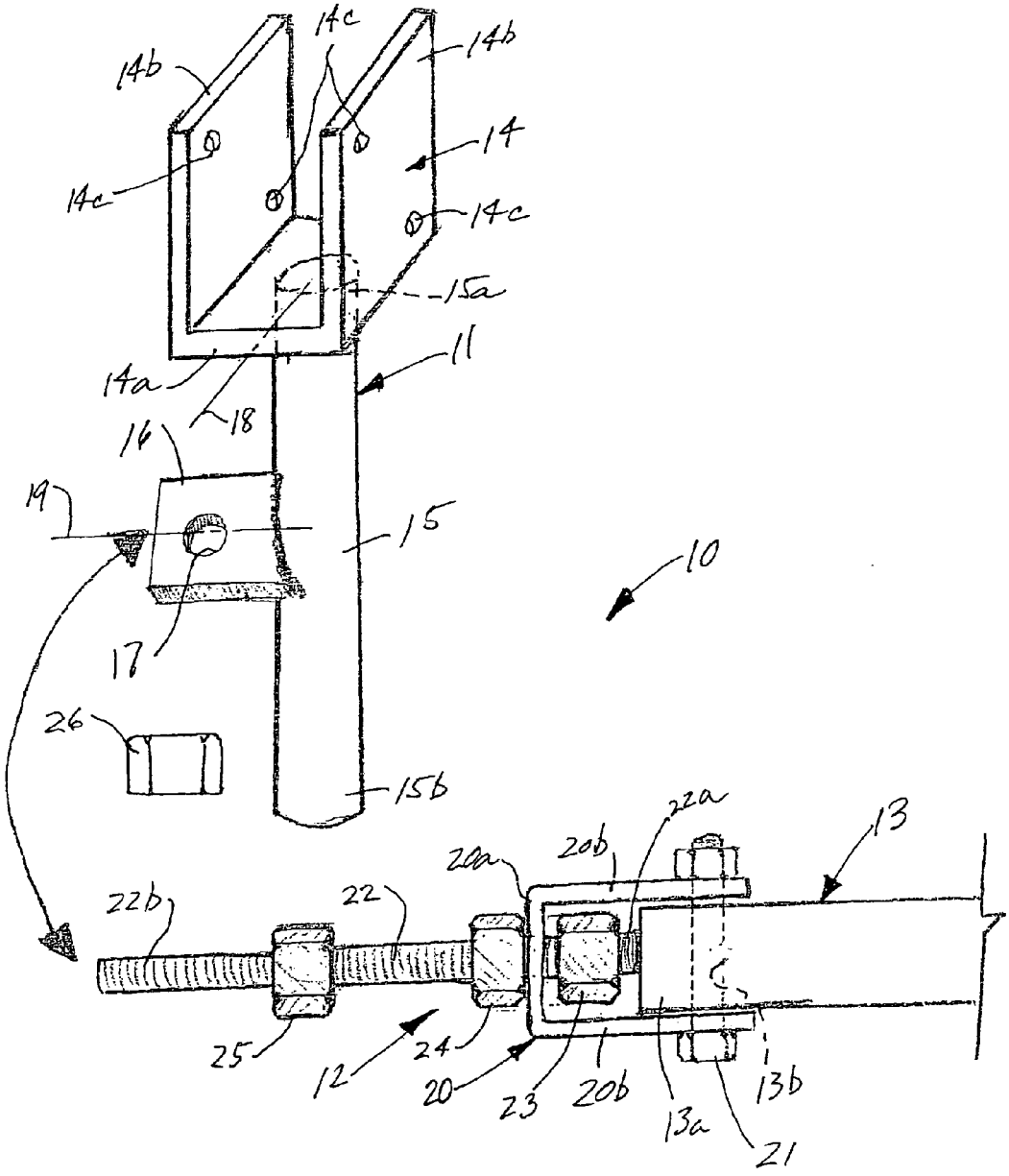
FIG. 1 is a perspective view of a bracket and anchor apparatus in accordance with the present invention before assembly.
Figure 2:
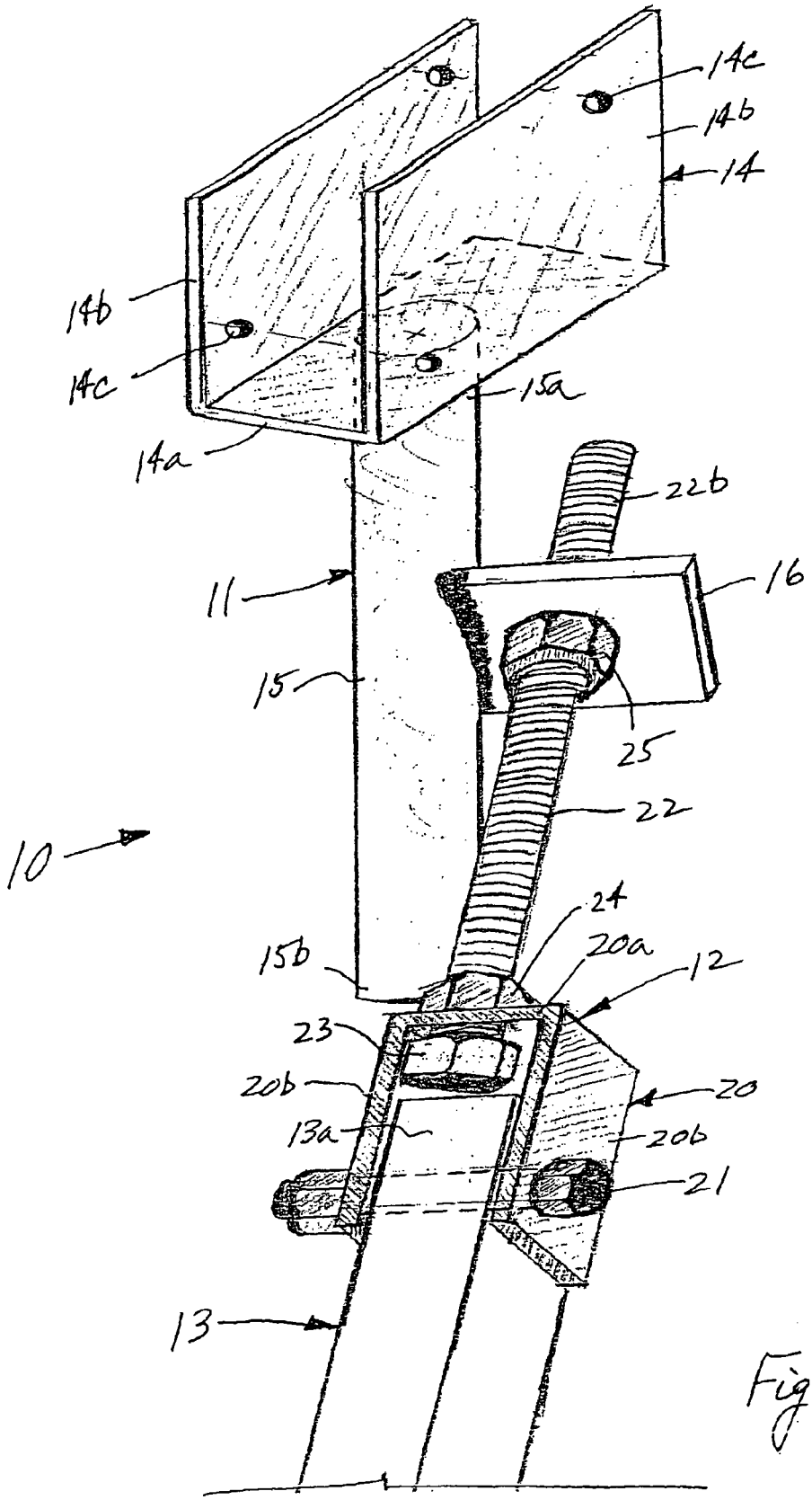
FIG. 2 is a perspective view of the bracket and anchor apparatus shown in FIG. 1 after assembly.

A bracket and anchor apparatus 10 is shown in FIGS. 1 and 2 for use in supporting walkways (not shown). The apparatus 10 includes a bracket 11, a connector assembly 12 and a battered helical anchor 13. The bracket 11 has a beam restrainer portion 14 formed in a generally U-shape for retaining a generally horizontally extending beam (typically wooden and not shown) which supports a floor of a walkway (not shown). The restrainer 14 has a horizontally extending bottom plate 14*a* upon which the beam rests and a pair of spaced apart vertically extending beam restraining side plates 14*b* restraining sideways movement of the beam. A plurality of apertures 14*c* are formed in the side plates 14*b* for receiving fasteners (not shown) for securing the beam to the restrainer 14. The apertures 14*c* may be formed so as to receive fasteners that pass through each of the side plates 14*b* and the beam. Alternatively, the apertures 14*c* may be formed so as to receive fasteners, such as screws or the like, that are embed in the beam while passing through only one of the side plates 14*b*. The dimensions of the restrainer 14 including the spacing between the side plates 14*b* can be selected to coordinate with the size of the beam to be supported. Although the restrainer 14 is shown formed as an integral part, one or both of the side plates 14*b* could be movably attached to the bottom plate 14*a* to accommodate different width beams, or a single side plate 14*b* could be located centrally on the bottom plate 14*a* to receive a beam on either side thereof. For example, the restrainer 14 could be formed as a pair of generally L-shaped members each including one of the side plates 14*b* and a bottom plate (similar to the bottom plate 14*a*) with the bottom plates overlapped to form a generally U-shaped member. One or both of the bottom plates would include an elongated bolt hole for receiving a bolt thereby adjustably positioning and securing together the L-shaped members.

Figure 3:
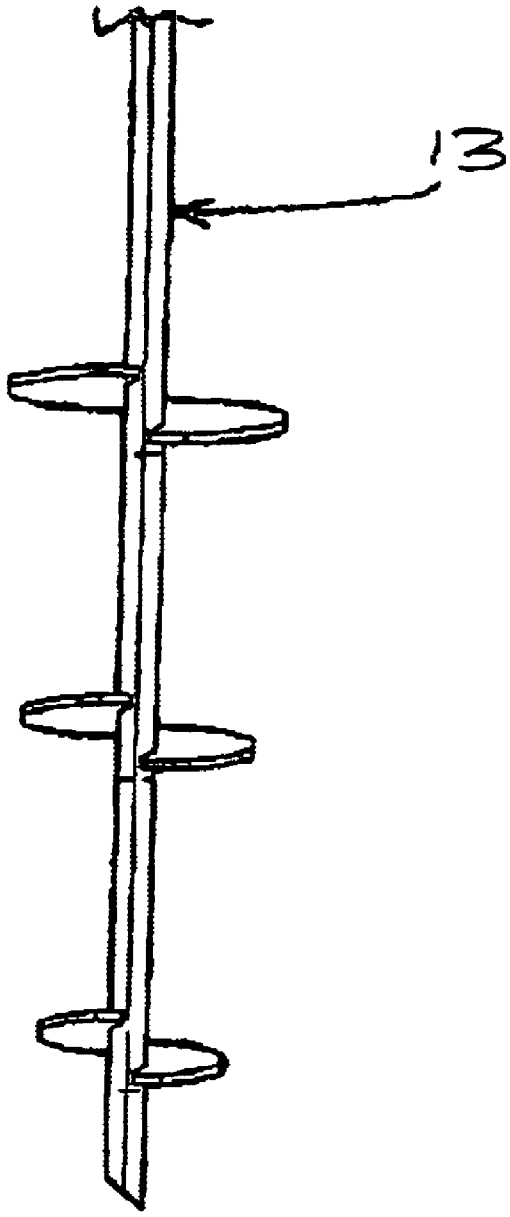
FIG. 3 is a perspective view of a battered helical anchor for use with the bracket and anchor apparatus shown in FIGS. 1 and 2.

The bottom plate 14*a* is attached to an upper end 15*a* of a vertically extending shaft 15 either fixedly, such as by a welded connection, or removably, such as with suitable fasteners or the like. The shaft 15 is hollow and has an open lower end 15*b* sized to slip over an upper end of a typical helical anchor, such as the anchor 13 shown in FIG. 3 or similar anchor, when used in a conventional manner. A connecting plate 16 extends radially from a central portion of the shaft 15 and has an aperture 17 formed therein. Preferably, the connecting plate 16 is welded to the central portion of the shaft 15. The connecting plate 16 extends in a plane that is between horizontal and vertical, such as an approximately 45° angle relative to a horizontal plane of the bottom plate 14*a* which plane is parallel to a longitudinal axis 18 of the restrainer 14. Also, the connecting plate 16 extends radially from the shalt 15 along an axis 19 that is at an approximately 45° horizontal angle relative to the longitudinal axis 18. Although 45° angles are used in this example, the two angles can be different and any suitable angles and directions can be used. The orientation of the connecting plate 16 advantageously permits the battered anchor 13 to resist walkway movement in all directions.

The connector assembly 12 has a U-shaped bracket 20 with a central portion 20*a* connecting a pair of legs 20*b*. The legs 20*b* receive an upper end 13*a* of the battered anchor 13 therebetween. Both the legs 20*b* and the upper end 13*a* have an aperture 13*b* formed therein for receiving a fastener 21 to attach the connecting bracket 12 to the anchor 13. A threaded rod 22 has a lower end 22*a* that extends through an aperture formed in the central portion 20*a* and engages the upper end 13*a*. A first nut 23 and a second nut 24 threadably engage the rod 22 on opposite sides of the central portion 20*a* and, when the bracket and anchor apparatus 10 is assembled, are rotated into contact with the central portion 20*a* to fix the rod 22 in place. With the rod 22 fixed in placed, the bracket and anchor apparatus 10 is in a state suitable to be connected to the beam restrainer portion 14.

During assembly, an upper end 22*b* of the rod 22 is inserted into the aperture 17, best seen in FIG. 2, and a third nut 25 on the rod 22 is rotated into contact with a lower surface of the connecting plate 16 to transfer a compression load from the bracket 11 through the connector assembly 12 to the upper end 13*a* of the anchor 13. A fourth nut 26 (shown in FIG. 1 and unattached) is threaded onto the upper end 22*b* and rotated into contact with an upper surface of the connecting plate 16 to transfer a tension load from the bracket 11 through the connector assembly 12 to the upper end 13*a* of the anchor 13. The nuts 23, 24, 25, and 26 allow the apparatus 10 to be adjusted on the construction site, advantageously providing greater flexibility when the apparatus 10 is installed. The nuts 25 and 26 cooperate with the threaded rod 22 to accommodate differences in the spacing between each of the connecting plates 16 and the upper end 13*a* of the associated screw anchor 13 at the installation locations along a walkway. When assembled, the connector assembly 12 forms a robust connection between the restrainer portion 14 and the battered helical anchor 13 and, therefore, is operable to transmit forces from the restrainer portion 14 to the battered helical anchor 13, allowing the apparatus 10 to resist walkway movement in all directions.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A bracket apparatus for connecting and supporting a beam of a walkway and a helical anchor, comprising:

a beam restrainer portion having a generally horizontally extending bottom plate for supporting a beam and at least one generally vertically extending side plate for attachment to the beam;

a generally vertically extending shaft having an upper end attached to said bottom plate and a lower end, said shaft including a connecting plate attached thereto and extending radially therefrom; and a connector assembly having an upper end releasably connected to said connecting plate and a lower end adapted to be connected to an upper end of a helical anchor, said connector assembly upper end being selectively attachable to said connecting plate to provide a length adjustment between said connecting plate and said connector assembly lower end.

2. The bracket apparatus according to claim 1 wherein said connecting plate extends in a plane angled from a plane in which said bottom plate extends.

3. The bracket apparatus according to claim 1 wherein said connecting plate extends radially at an angle from a longitudinal axis of said beam restrainer portion.

4. The bracket apparatus according to claim 1 wherein said connecting plate is welded to said shaft.

5. The bracket apparatus according to claim 1 wherein said connector assembly includes a threaded rod having an upper end and a lower end, said upper end extending through an aperture formed in said connecting plate and being releasably attached to said connecting plate by a pair of nuts threadably engaging said rod.

6. The bracket apparatus according to claim 5 wherein said lower end of the thread rod is attached to a bracket by another pair of nuts threadably engaging said rod.

7. The bracket apparatus according to claim 6 wherein said bracket is generally U-shaped for receiving the upper end of the helical anchor.

8. The bracket apparatus according to claim 1 wherein said at least one side plate of said beam restrainer portion includes a plurality of apertures formed therein, said apertures operable to receive fasteners for securing the beam to said at least one side plate.

9. A bracket for use in supporting a walkway comprising:

a bracket including a beam restrainer having a generally horizontally extending bottom plate for supporting a beam and at least one generally vertically extending side plate for attachment to the beam, a generally vertically extending shaft having an upper end attached to said bottom plate, and a connecting plate attached to and extending radially from said shaft in a plane angled from a plane of said bottom plate; and a connector assembly including a threaded rod having an upper end releasably attached to said connecting plate and a lower end, and a bracket releasably attached to said rod lower end, said rod upper end being attached to said connecting plate in a selected one of a plurality of positions along said rod, said bracket adapted to be attached to an end of a helical anchor.

10. The bracket according to claim 9 wherein said connecting plate extends radially at an angle from a longitudinal axis of said beam restrainer.

11. A walkway supporting bracket and anchor apparatus comprising:

a screw anchor having an upper end with an aperture formed therein;

a connector assembly having a lower end releasably attached to said screw anchor upper end by a fastener extending through said aperture; and a bracket assembly releasably attached to an upper end of said connector assembly for transferring a load applied to said bracket to said helical anchor, said bracket assembly including a beam restrainer having a generally horizontally extending bottom plate for supporting a beam and at least one generally vertically extending side plate for attachment to the beam, a generally vertically extending shaft having an upper end attached to said bottom plate, and a connecting plate attached to and extending radially from said shaft in a plane angled from a plane of said bottom plate, said connecting plate being releasably attached to said upper end of said connector assembly.

12. The apparatus according to claim 11 wherein said connector assembly includes a generally U-shaped bracket having a pair of legs, said upper end of said screw anchor extending between said legs and said fastener extending through said legs.

13. The apparatus according to claim 12 wherein said connector assembly includes a threaded rod releasably attached at a lower end to said generally U-shaped bracket and releasably attached at an upper end to said bracket assembly.

* * * * *